United States Patent [19]

Johnson

[11] Patent Number: 4,854,054

[45] Date of Patent: Aug. 8, 1989

[54] FABRIC DRYER AIRFLOW SYSTEM

[75] Inventor: Thomas M. Johnson, Newton, Iowa

[73] Assignee: Maytag Corporation, Newton, Iowa

[21] Appl. No.: 211,830

[22] Filed: Jun. 27, 1988

[51] Int. Cl.[4] ..... F26B 11/04

[52] U.S. Cl. ..... 34/133; 34/82

[58] Field of Search ..... 34/82, 133, 132, 134, 34/131

[56] References Cited

U.S. PATENT DOCUMENTS

| | | | |
|---|---|---|---|
| 2,751,688 | 6/1956 | Douglas | 34/82 |
| 2,798,306 | 7/1957 | Reiter | 98/133 |
| 3,320,683 | 5/1967 | Worst | 34/139 |
| 3,364,588 | 1/1968 | Ziegler | 34/56 |
| 3,789,514 | 2/1974 | Faust et al. | 34/82 |
| 4,033,047 | 7/1977 | Kawai | 34/82 |

*Primary Examiner*—Henry A. Bennet
*Assistant Examiner*—J. Sollecito
*Attorney, Agent, or Firm*—Richard L. Ward

[57] ABSTRACT

A fabric dryer includes a front bulkhead assembly providing a pair of airflow outlets from the drying chamber. A first airflow outlet is associated with the stationary front bulkhead adjacent the access opening of the fabric dryer. A second airflow outlet is integral with the lint filter and is located within an airflow space formed between the access opening and a projecting portion of the access door. The projecting portion of the access door generally overlies the second airflow outlet to protect the outlet from blockage by fabrics being tumbled.

11 Claims, 4 Drawing Sheets

FABRIC DRYER AIRFLOW SYSTEM

BACKGROUND OF THE INVENTION

This invention relates generally to the field of fabric drying apparatus and in particular to a bulkhead assembly having plural airflow outlets. The bulkhead assembly provides for continuous airflow through the fabric drying apparatus even if one of the airflow outlets becomes obstructed.

Douglas, in U.S. Pat. No. 2,751,688 issued June 26, 1956, discloses a laundry dryer having a lint filter mounted in the front wall over the entry to the exhaust blower. A portion of an access door overlies the lint filter area and forms part of the structure defining an airflow passage to the lint filter. Airflow moves through the access opening, through the airflow passage and finally through the lint filter into the exhaust blower. There is only one airflow path to the lint filter.

Worst, in U.S. Pat. No. 3,320,683 issued May 23, 1967, shows a lint filter arrangement disposed in the lower portion of a dryer access opening. The inner face of the access door is perforate and allows airflow into the access door assembly and through an opening in the access door assembly into the lint filter. Again, there is only one airflow path to the lint filter.

Faust et al, in U.S. Pat. No. 3,789,514 issued Feb. 5, 1974 and assigned to the assignee of the instant invention, teach a bulkhead mounted filter assembly having a perforate grid-like air inlet facing the interior of the fabric tumbling chamber. The single airflow path to the lint filter is through the grid-like air inlet.

The prior art has thus shown a number of lint filter arrangements for fabric dryers. All of these prior art lint filter arrangements provide only a single airflow path from the drying chamber.

SUMMARY OF THE INVENTION

It is therefore an object of the instant invention to provide an improved airflow system for a fabric drying apparatus.

It is a further object of the instant invention to provide an airflow system having primary and secondary airflow outlets.

It is a still further object of the instant invention to provide an improved airflow system for a fabric drying apparatus having a secondary airflow outlet which is protected from blockage by articles being dried.

Briefly, the instant invention achieves these objects in a fabric drying apparatus including a cabinet with a front panel having an access opening therethrough and apparatus defining a chamber for tumbling articles including a rotatable peripheral wall and a stationary bulkhead juxtaposed the front end thereof. A tunnel-like structure extends between the bulkhead and the front panel defining a passageway between the chamber and the access opening in the front panel. A first outlet is associated with the bulkhead and defines a first airflow egress from the chamber. A second outlet is associated with the tunnel-like structure and defines a second airflow egress from the chamber. A duct is in airflow communication with the first and second outlets for conducting airflow away from the chamber. Mechanism is provided for producing an airflow through the chamber and the first and second outlets into the duct. A door is operable for selectively closing the access opening. There is also provided structure disposed within the tunnel-like structure for providing a generally protected airflow path from the chamber to the second airflow egress.

Operation of the drying apparatus and further objects and advantages thereof will become evident as the description proceeds and from an examination of the accompanying four pages of drawings.

BRIEF DESCRIPTION OF THE DRAWINGS

The drawings illustrate a preferred embodiment of the invention with similar numerals referring to similar parts throughout the several views wherein.

DESCRIPTION OF A PREFERRED EMBODIMENT

Figure 1:
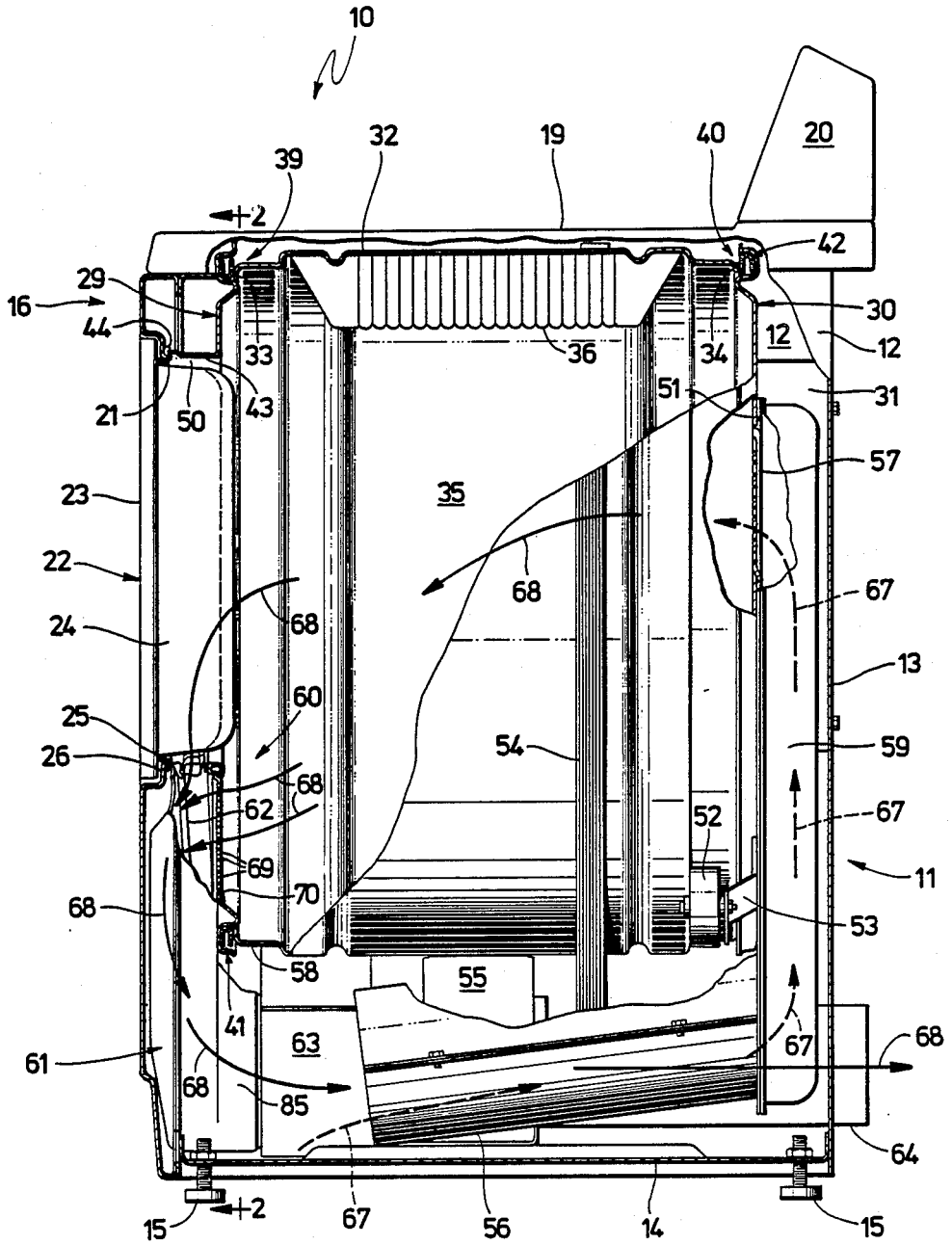
FIG. 1 shows an overall view of a fabric drying apparatus partially cut away and sectioned to show the instant invention embodied therein.

Referring now to FIG. 1 in particular there is shown the overall construction of a fabric dryer 10 including a cabinet assembly comprising a side wall wrapper 11 having generally vertical opposite side panels 12 and a rear panel 13. The side wall wrapper 11 is supported on a base 14 which in turn is supported on a horizontal surface through a plurality of adjustable feet 15. The cabinet assembly further comprises a front panel 16 and a top cover 19 supported on the side wall wrapper 11. The top cover 19 includes an upwardly extending housing 20 for accommodating various controls for the fabric dryer 10.

The front panel 16 has a generally central access opening 21 and an access door 22 is hinged on the front panel 16 for operation between open and closed positions relative to the access opening 21. The door 22 includes an outer panel 23 substantially flush with the front panel 16 and an inner panel or door liner 24 having a projecting portion that extends rearwardly through the access opening 21. A seal 25 supported by the inner panel 24 extends around the rearwardly projecting portion of the inner panel 24 for engagement with a recessed portion 26 of the front panel adjacent the access opening 21 to effectively provide an air seal at the access opening 21.

Disposed within the cabinet assembly is a pair of spaced-apart generally vertical front and rear bulkheads 29 and 30. The rear bulkhead 30 is fixed to the side wall wrapper 11 by a pair of brackets such as the bracket 31 connected to the rear panel 13. The front bulkhead 29 is similarly connected to the front flanges of the side panels 12.

A generally cylindrical peripheral side wall 32 is disposed for rotation between the stationary bulkheads 29 and 30. At the front and at the rear of the peripheral side wall 32 there are inwardly turned flanges comprising relatively short end walls 33 and 34 juxtaposed the front and rear bulkheads 29 and 30 and cooperable with the peripheral side wall 32 and bulkheads 29 and 30 to effectively define a fabric drying chamber 35. A plurality of baffle members 36 are fixed to the peripheral side wall 32 and extend radially into the drying chamber 35 for assisting in the movement of fabrics therewithin during rotation of the peripheral side wall 32.

The front and rear bulkheads 29 and 30 include generally annular recesses 39 and 40 facing the short end walls 33 and 34, respectively, of the peripheral side wall 32. Seals 41 and 42 are fixed to the bulkheads 29 and 30 in the recesses 39 and 40 and are engageable with the facing short end walls 33 and 34 to provide an air seal at the ends of the fabric drying chamber 35.

Figure 3:
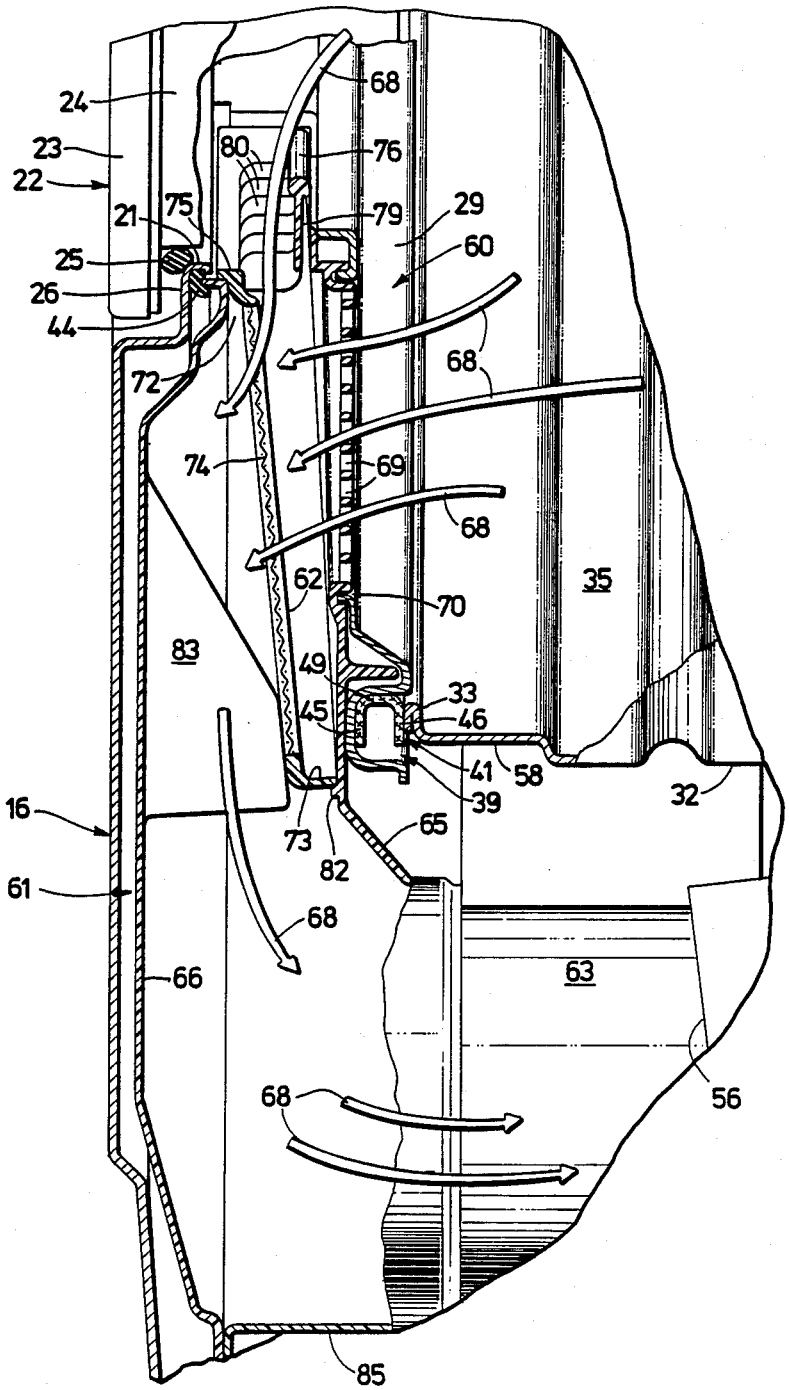
FIG. 3 is a fragmentary section view taken generally along lines 3—3 of FIG. 2.

Referring to FIGS. 1 and 3, the seal 41, for example, disposed between the stationary bulkhead 29 and the rotatable peripheral side wall 32 is shown as a U-shaped or channel-shaped felt member having a pair of generally outwardly extending legs 45 and 46 connected to an intermediate arcuate portion. The leg 45 is fixed, as with adhesive, to the stationary bulkhead 29 in the recess 39 so that the intermediate arcuate portion conforms generally to the corner radius 49 and effectively biases the other leg 46 into engagement with the short end wall 33 of the peripheral side wall 32. The felt may be coated on one side with an antifriction layer such as polytetrafluoroethylene to provide a smooth, more durable, and lower friction running surface for engagement with the end wall 33.

Figure 2:
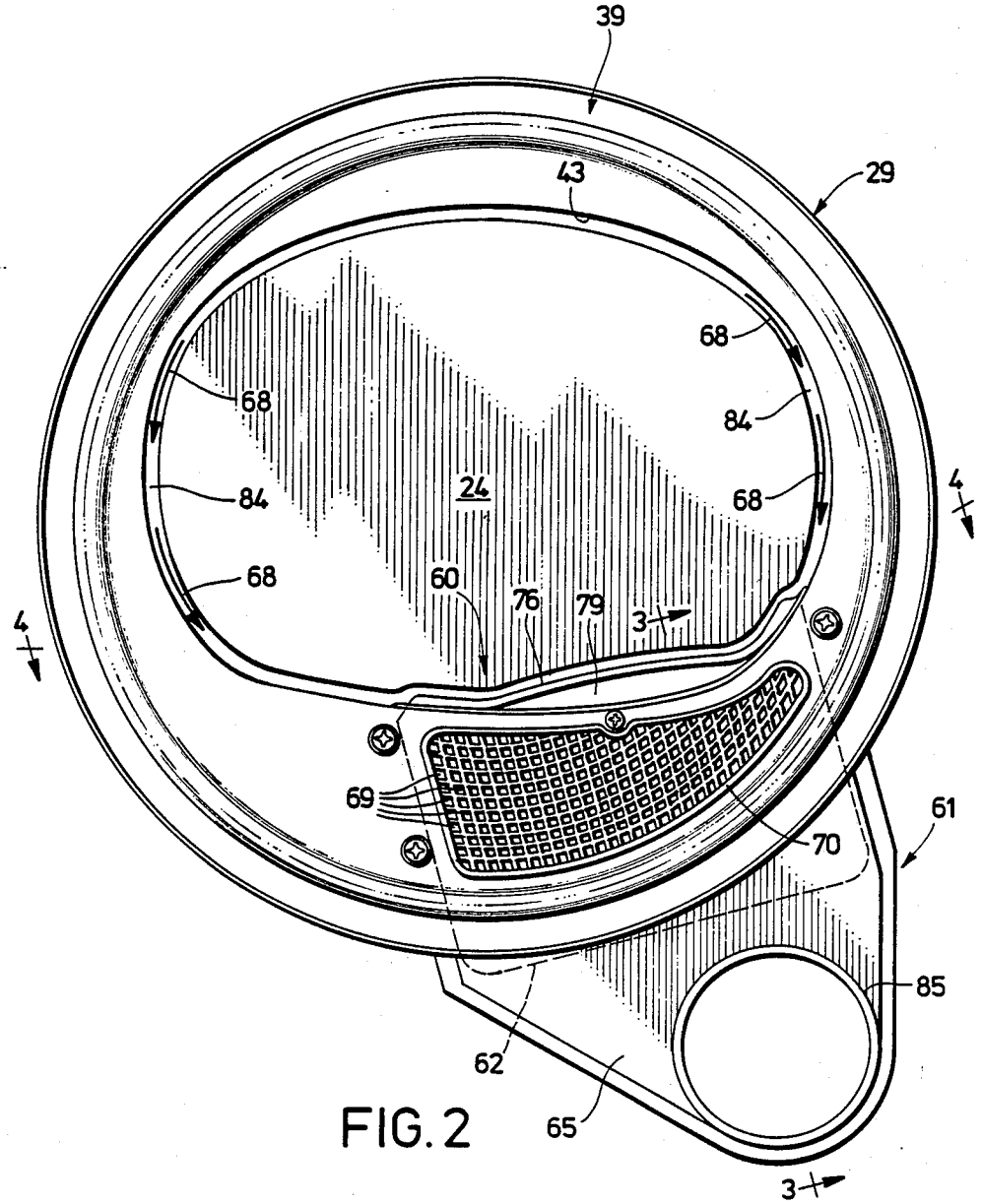
FIG. 2 is a view taken generally along lines 2—2 of FIG. 1 showing the airflow outlet system of the instant invention assembled to the bulkhead of the fabric drying apparatus.
Figure 4:
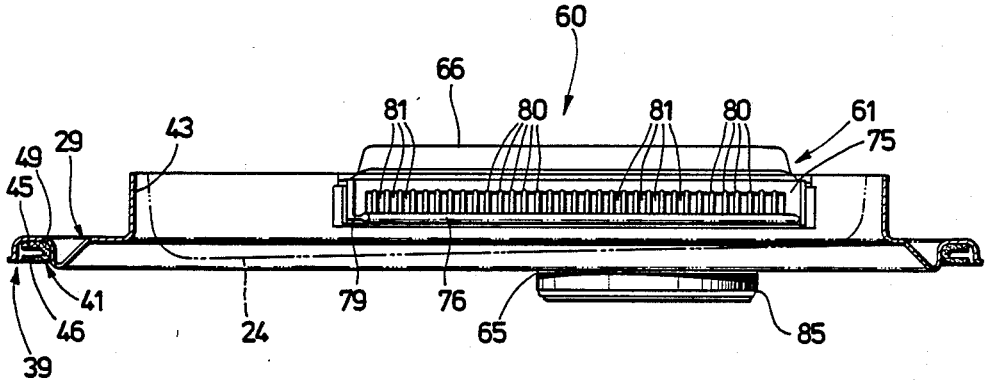
FIG. 4 is a view taken generally along lines 4—4 of FIG. 2.

FIGS. 1, 2 and 4 best show that the front bulkhead 29 includes a collar 43 that is forwardly extending as in FIG. 1, generally oval shaped as in FIG. 2 and is substantially axially aligned with the access opening 21 in the front panel 16. As best shown in FIG. 1, the collar 43 is sealed to the rear of the front panel 16 by gasket 44. The collar 43 thus is generally cooperable with the access opening 21 to form a tunnel-like passageway 50 extending horizontally between the front panel 16 and the drying chamber 35.

As further shown in FIG. 1, the rear bulkhead 30 includes an opening 51 for receiving a perforate panel 57 formed integrally with the air duct 59 and through which heated airflow is directed into the drying chamber 35 as will be further described.

The peripheral side wall 32 is supported on a generally horizontal axis by a system including a pair of rollers 52 supported on brackets 53 fixed to the rear bulkhead 30 and by a pair of slide bearings (not shown) supported by brackets fixed to the front bulkhead 29 and engageable with annular surface 58. The peripheral side wall 32 could be supported entirely on rollers or entirely on slides as conditions warrant.

As further shown in FIG. 1, the peripheral side wall 32 is rotated by a belt 54 encompassing the periphery thereof and driven by a motor 55 mounted on the base 14.

As best shown in FIGS. 1 and 3, the airflow system for the fabric dryer 10 includes a heater housing 56 supported adjacent the base 14 and into which air is drawn from the immediate surroundings for heating prior to movement into the drying chamber 35. The heater housing 56 may accommodate either a gas or electric heating unit. The heater housing 56 is connected to a generally upwardly extending rear air duct 59 which conducts heated air from the heater housing 56 through the perforate panel 57 and into the drying chamber 35.

The heated air flows from the drying chamber 35 through a filter assembly 60 into the front air duct 61. The filter assembly 60 includes a lint filter 62 disposed within the front air duct 61 for removing lint particles from the air flowing out of the drying chamber 35 into the front air duct 61.

The air is drawn from the front air duct 61 into a blower assembly 63 from which it is forced through a rearwardly extending lower air duct 64 to atmosphere. The blower assembly 63 includes an impeller driven by the motor 55 mounted adjacent the blower assembly 63 on the base 14. The general airflow pattern within the fabric dryer 10 is shown by the dashed and solid line arrows 67 and 68. The dashed arrows 67 depict room temperature air being drawn into the heater housing 56, through the rear air duct 59 and into the drying chamber 35. The solid arrows 68 show heated air passing through the drying chamber 35, into the filter assembly 60, through the blower assembly 63 and through the lower air duct 64 to atmosphere.

Referring now to FIGS. 2–4 in particular, the lint filtering arrangement for the fabric dryer 10 of FIG. 1 will be discussed in detail. In FIG. 2, the front air duct 61 is shown assembled to the front bulkhead 29 and the inner panel 24 of the door 22 is shown in the door closed posture for closing the access opening 21.

As best shown in FIGS. 2 and 3, the front air duct 61 is a relatively thin, generally rectangular box-like structure. The first and second halves 65 and 66 of the front air duct 61 are preferably molded from a thermoplastic material and the two halves are joined by a method such as ultrasonic welding, solvent welding or by the use of mechanical fasteners to form a housing defining the front air duct 61. As best shown in FIG. 2, the first half 65 of the front air duct 61 has a grid-like pattern of openings 69 oriented in a generally triangular arrangement and partially offset to the right of the vertical center line of the collar 43 formed in the front bulkhead 29. This grid-like pattern of openings 69 form the primary airflow egress from the chamber 35 into the front air duct 61. As further shown in FIGS. 2 and 3, the grid-like pattern of openings 69 are cooperable with a similarly shaped mating aperture 70 formed in the front bulkhead 29 when the front air duct 61 is attached thereto.

As an alternate construction, it is anticipated that the front bulkhead 29 may be formed with a plurality of extruded apertures in a similar generally triangular arrangement to provide substantially the same cross sectional open area as that provided by the grid-like pattern of openings 69. The first half 65 of the front air duct 61 would then be molded with a mating opening.

The upper portion of the first and second halves 65 and 66 of the front air duct 61 when assembled, substantially conform to the generally oval contour of the lower right side of the collar 43 as viewed from the perspective of FIGS. 2 and 4. That portion of the collar 43 is cut away to receive the front air duct 61. As indicated in FIG. 3, the front air duct 61 further includes a substantially rectangular top opening 72 for receiving the lint filter 62 which will be further discussed herein.

Referring again to FIGS. 2–4, there is shown the lint filter 62 which is removably associated with the front air duct 61. The lint filter 62 is molded with a substantially rectangular frame 73 having a generally L-shaped cross section as best shown in FIG. 3. As further shown in FIG. 3, a section of filter screen 74 is directly molded into the frame 73.

The lint filter 62 also includes an upper flange 75 which conforms to the contour of the upper surface of the front air duct 61. The lint filter 62 extends downwardly through the rectangular opening 72 and the upper flange 75 is contoured so that it rests on the upper surface of the front air duct 61. A generally upstanding handle 76 is integrally molded into the top of the lint filter 62. The handle 76 extends upwardly and includes a substantially vertical wall portion 79 generally parallel with the vertical plane of the front bulkhead 29.

As best shown in FIGS. 3 and 4, the lint filter 62 has a plurality of ribs 80 extending generally upwardly from the flange 75. The flange 75 is open between each rib 80 to define a plurality of apertures or ports 81 forming a secondary airflow egress from the chamber 35 into the front air duct 61.

FIG. 3 best shows the lint filter 62 located within the front air duct 61. The lint filter 62 extends downwardly through the opening 72 in the front air duct 61 and the lower portion of the frame 73 rests on a ledge 82 which extends across the first half 65 of the front air duct 61. The lint filter 62 is guided toward the ledge 82 by at least one downwardly sloping locating member 83 molded into the second half 66 of the front air duct 61.

In FIG. 2, the inner panel 24 of the door 22 is shown with the door 22 in the closed posture. The profile of the inner panel 24 is also shown in phantom lines in FIG. 4. The inner panel 24 and the collar 43 are spaced approximately $\frac{3}{8}$ inch apart all around the periphery, in the preferred embodiment of the invention, to form a peripheral airflow space 84 therebetween. Airflow, as depicted by the solid arrows 68 in FIG. 2, is drawn into the airflow space 84 and through the secondary airflow egress defined by the ribs 80. The lower right side of the inner panel 24 is formed, as again shown in FIG. 2, to parallel the shape of the handle 76 of the lint filter 62. The inner panel 24 of the door 22 extends inwardly over the handle 76 and the secondary airflow egress so that the secondary airflow egress to the lint filter 62 is protected from blockage by tumbling articles of clothing.

In addition to providing the peripheral airflow space 84, the inner panel 24 of the door 22, as shown in FIGS. 1 and 4, is generally flush with the front bulkhead 29 on the right side of the collar 43. The inner panel 24 tapers from right to left into the drying chamber 35 of the fabric dryer 10. With the peripheral side wall 32 rotating in a counterclockwise direction as viewed from the perspective of FIG. 2, the baffle members 36 will pick up articles of clothing and allow them to free fall toward the bottom of the drying chamber 35. With the inner door 24 generally flush with the front bulkhead 29 on the side of the primary airflow egress from the chamber 35, articles of clothing will be readily moved upward and away from the area of the primary airflow egress. As articles of clothing are tumbled and free fall toward the bottom of the drying chamber 35, the left side of the inner door 24 will urge the clothing away from the front bulkhead 29. This action will also help protect the finish of the front bulkhead 29 from damage by buttons, zippers, snaps, etc. Also, the clothing will be constantly urged away from the front bulkhead 29 and into the drying chamber 35.

In operation, heated air enters the drying chamber 35 through the rear air duct 59 and passes by and through articles of clothing to remove moisture therefrom. The moisture laden air enters the front air duct 61 by way of the primary and secondary airflow egresses located upstream from the lint filter 62. The air from both airflow egresses passes through the lint filter 62 to remove lint and other foreign articles and proceeds through the outlet 85 of the front air duct 61 into the blower assembly 63 and is then exhausted to atmosphere through the lower air duct 64. The dual airflow egresses from the chamber 35 to the lint filter 62 ensure airflow through the fabric dryer 10 and help prevent cycling of the fabric dryer 10 on the high limit thermostat.

There has thus been described herein a fabric dryer having a unique airflow and lint filter assembly. A primary airflow egress in the front bulkhead of the fabric dryer and a protected secondary airflow egress are provided so that the fabric dryer will always have airflow therethrough even if the primary airflow egress from the chamber should be blocked.

In the drawings and specification, there has been set forth a preferred embodiment of the invention and although specific terms are employed these are used in a generic and descriptive sense only and not for purposes of limitation. Changes in the form and proportion of parts as well as the substitution of equivalents are contemplated as circumstances may suggest or render expedient without departing from the spirit or scope of the invention as further defined in the following claims.

I claim:

1. A fabric drying apparatus, the combination comprising: cabinet means including a front panel having an access opening therethrough; means defining a chamber for tumbling articles including a rotatable peripheral wall and a stationary bulkhead juxtaposed the front end thereof; tunnel-like wall structure extending between said bulkhead and said front panel defining a passageway between said chamber and the access opening in said front panel; first outlet means through said bulkhead defining a first airflow egress from said chamber; second outlet means through said tunnel-like wall structure defining a second airflow egress from said chamber; duct means including housing means defining a first opening in airflow communication with said first outlet means and a second opening in airflow communication with said second outlet means for conducting airflow away from said chamber; means for producing an airflow through said chamber and said first and second outlet means into said duct means; door means for selectively closing said access opening; and means disposed within said tunnel-like wall structure for providing a generally protected airflow path from said chamber to said second airflow egress.

2. A fabric drying apparatus as defined in claim 1 and further including filter means disposed downstream from said first and second airflow egresses.

3. A fabric drying apparatus as defined in claim 1 wherein said means disposed within said tunnel-like structure comprises an inwardly projecting portion of said door means.

4. A fabric drying apparatus, the combination comprising: cabinet means including a front panel having an access opening therethrough; means defining a chamber for tumbling articles including a rotatable peripheral wall and a stationary bulkhead juxtaposed the front end thereof; tunnel-like structure extending generally horizontally between said bulkhead and said front panel defining a passageway between said chamber and the access opening in said front panel; outlet means associated with said bulkhead defining a first airflow egress from said chamber; filter means associated with said tunnel-like structure including a flange member having at least one opening defining a second airflow egress from said chamber; duct means in airflow communication with said first and second airflow egresses for conducting airflow away from said chamber; means for producing an airflow through said chamber and said first and second airflow egresses into said duct means; and door means for selectively closing said access opening including a projecting portion interposed in said tunnel-like structure, said projectihg portion being cooperable with said tunnel-like structure to provide a generally protected airflow path between said chamber and said second airflow egress, said filter means further including means disposed in said duct means downstream from the first and second airflow egresses for removing lint particles from the airflow.

5. A fabric drying apparatus as defined in claim 4 wherein said projecting portion of said door means is cooperable with said tunnel-like structure to define an airflow space therebetween leading to said second airflow egress.

6. A fabric drying apparatus as defined in claim 4 wherein said outlet means comprises a grid-like pattern of openings formed in said duct means and mounted within an outlet aperture located in said bulkhead.

7. A fabric drying apparatus, the combination comprising: cabinet means including a front panel having an access opening therethrough; means defining a chamber for tumbling articles including a rotatable peripheral wall and a stationary bulkhead juxtaposed the front end thereof; tunnel-like structure extending generally horizontally between said bulkhead and said front panel defining a passageway between the access opening in said front panel and said chamber; outlet means associated with said bulkhead defining a first airflow egress from said chamber; filter means including a flange member associated with said tunnel-like structure and having at least one opening defining a second airflow egress from said chamber and relatively isolated from said first airflow egress; duct means in airflow communication with said first and second airflow egresses for conducting airflow away from said chamber; means for producing an airflow through said chamber and said first and second airflow egresses into said duct means; and door means for selectively closing said access opening including a projecting portion interposed in said tunnel-like structure in substantial overlying juxtaposition to said second airflow egress to provide an airflow space between said tunnel-like structure and said projecting portion and guard said second airflow egress from blockage, the combination of said airflow space, said projecting portion and said second airflow egress providing a protected airflow path from said chamber into said duct means even when said first airflow egress is blocked.

8. A fabric drying apparatus as defined in claim 7 wherein said filter means includes a handle portion integral with said flange member effectively forming an extension of said bulkhead to further guard said second airflow egress from blockage.

9. A fabric drying apparatus as defined in claim 7 wherein said filter means is laterally offset from a centerline of said access opening.

10. A fabric drying apparatus as defined in claim 7 wherein said projecting portion tapers from side-to-side and is substantially flush with the generally vertical plane of said bulkhead on the filter side of said tunnel-like structure to protruding into said chamber on the opposite side for deflecting articles being dried into said chamber.

11. A fabric drying apparatus, the combination comprising: cabinet means including a front panel having an access opening therethrough; means defining a chamber for tumbling articles including a rotatable peripheral wall and a stationary bulkhead juxtaposed the front end thereof; tunnel-like structure extending between said bulkhead and said front panel defining a passageway between said chamber and the access opening in said front panel; first outlet means associated with said bulkhead defining a first airflow egress from said chamber; second outlet means associated with said tunnel-like structure defining a second airflow egress from said chamber; duct means in airflow communication with said first and second outlet means for conducting airflow away from said chamber; means for producing an airflow through said chamber and said first and second outlet means into said duct means; filter means disposed downstream from said first and second airflow egresses, said filter means being at least partially disposed in said duct means and including a flange member associated with said tunnel-like structure and having at least one opening forming said second airflow egress; door means for selectively closing said access opening; and means disposed within said tunnel-like structure for providing a generally protected airflow path from said chamber to said second airflow egress.

* * * * *